United States Patent [19]

Johnson

[11] 4,044,751

[45] Aug. 30, 1977

[54] RADIANT ENERGY HEATING SYSTEM WITH POWER EXHAUST AND EXCESS AIR INLET

[75] Inventor: Arthur C. W. Johnson, Troy, Mich.

[73] Assignee: Combustion Research Corporation, Pontiac, Mich.

[21] Appl. No.: 578,764

[22] Filed: May 19, 1975

[51] Int. Cl.[2] ..... F24C 3/06

[52] U.S. Cl. ..... 126/91 A; 431/351

[58] Field of Search ..... 126/91 A, 91 R; 431/351, 353, 188

[56] References Cited

U.S. PATENT DOCUMENTS

| | | | |
|---|---|---|---|
| 2,281,206 | 4/1942 | Schoen | 126/91 A |
| 2,796,118 | 6/1957 | Parker et al. | 126/91 A X |
| 2,903,051 | 9/1959 | Blackman | 126/91 A X |
| 3,229,748 | 1/1966 | Spielman | 431/188 X |
| 3,273,621 | 9/1966 | Childree | 431/351 X |
| 3,399,833 | 9/1968 | Johnson | 237/53 |
| 3,463,602 | 8/1969 | Bitterlich et al. | 431/188 |
| 3,544,246 | 12/1970 | Meyer | 431/188 X |

*Primary Examiner*—William E. Wayner

*Assistant Examiner*—William E. Tapolcai, Jr.

*Attorney, Agent, or Firm*—Krass & Young

[57] ABSTRACT

A tube-fired radiant energy heating system comprising a burner of high rated capability and having a combustion chamber which is connected to an elongate radiant energy emitter tube typically carring a directing reflector, and connected at the output end to a power exhaust fan. Fixed primary and adjustable excess air inlet means are provided at the burner unit to permit excess air to be continuously drawn around the combustion chamber and into the radiant energy heater tube to be mixed with the ignited primary fuel/air mixture at the inlet to the heater tube. This method of firing permits the construction of the apparatus using lower cost materials which, if used in a burner system fired at Stoichiometric fuel-/air ratios, would be thermally oxidized and weakened. The excess air flow results in the control of the emitted air temperature to safe levels, minimizing oxidation and maintaining the high tensile strength with high BTU inputs. The system also affords economic benefits in size and weight of materials, use of less costly alloys and finishes. The lower overhead temperatures also permit reduced tube mounting heights.

13 Claims, 8 Drawing Figures

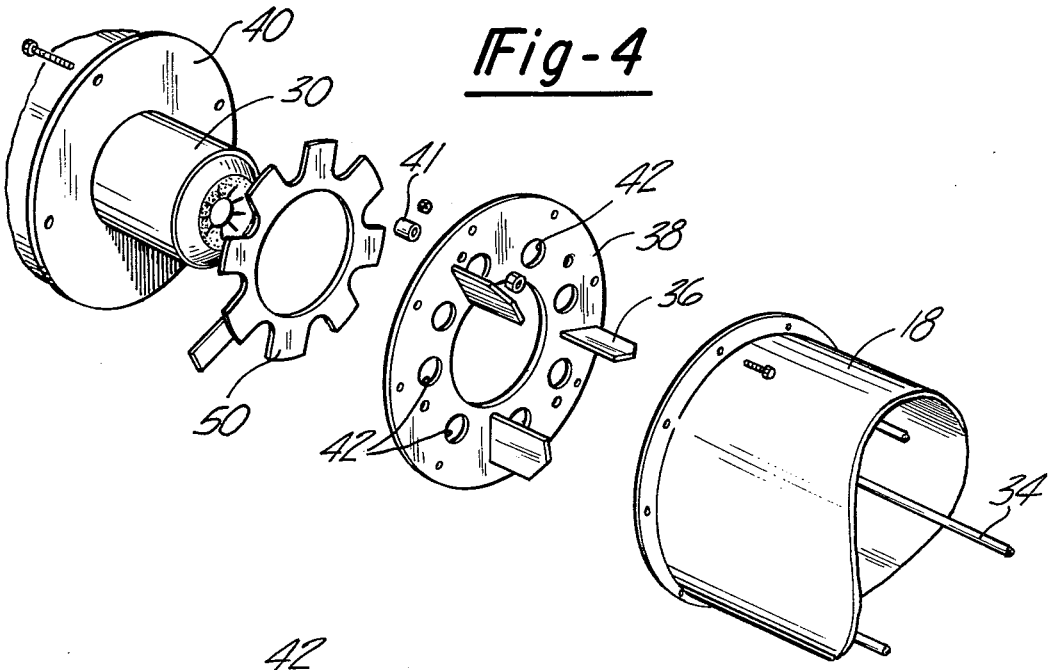
Fig-4
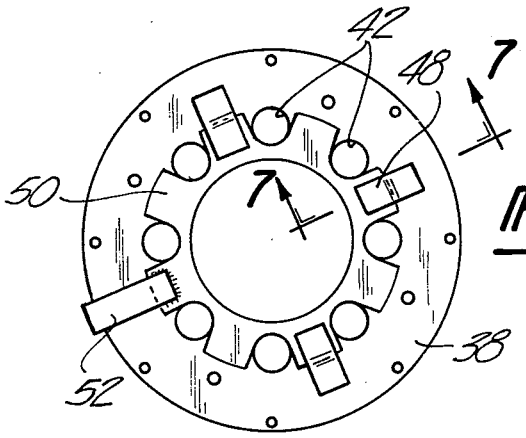
Fig-5
Fig-7
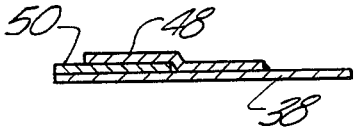
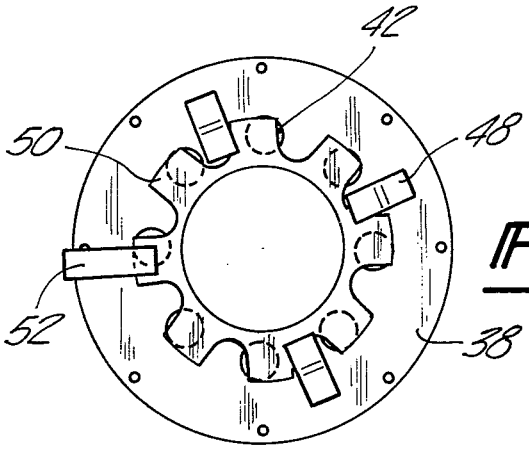
Fig-6
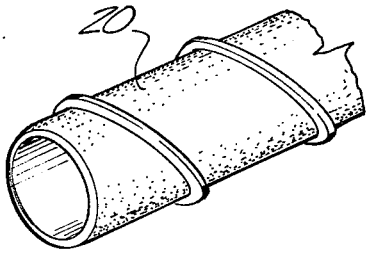
Fig-8

RADIANT ENERGY HEATING SYSTEM WITH POWER EXHAUST AND EXCESS AIR INLET

INTRODUCTION

This invention relates to improvements in radiant energy heating systems of the type comprising a burner and an elongated emitting tube with reflective shield usually disposed overhead in the area to be heated and extending from the burner to a power driven exhaust facility.

BACKGROUND OF THE INVENTION

Tube-fired radiant energy heater systems are frequently used in industrial and commercial buildings which are difficult to heat. In such applications, radiant energy heating systems are regarded as superior to forced air systems from the standpoints of economy and comfort, in minimizing the stratification of heat from top to bottom in a building, and in fuel savings. An example of a tube-fired radiant energy heating system is disclosed in the patent to Arthur C. W. Johnson, U.S. Pat. No. 3,399,833.

Another example of a tube-fired radiant energy heater system is disclosed in the patent to Cox. U.S. Pat. No. 3,786,799. The burner of the Cox heater system comprises a cylindrical combustion chamber having an igniter assembly disposed adjacent one end. The Cox burner includes a check valve assembly for minimizing pulsations in combustion chamber and emitter tube pressure by opening and closing in sympathy with burner pressure pulses. The valve acts as a breather to relieve noise producing shock waves.

BRIEF SUMMARY OF THE INVENTION

The present invention contemplates the combination of a burner unit having a combustion chamber wherein a chemically correct fuel/air mixture; i.e., a Stoichiometric fuel/air ratio, is burned, an elongate heater tube connected to the burner to receive the products of combustion and heated air, a power exhaust means for positively drawing air through the heater tube from the burner end to the exhaust end and means for admitting excess air, typically ambient, to the inlet end of the heater tube such that said excess air tempers the products of combustion which are entered into the tube but without actually entering into the combustion volume itself. Advantages which arise from this specific combination include cooling of inlet air without disturbing the air/fuel ratio necessary for good combustion, a reduction in the strength and heat and oxidation resistant characteristics of the heater tube thus allowing the use of lighter, less expensive materials such as aluminized steel, and the increased useability range of the burner over an expanded BTU range; i.e., a large capacity burner is specified and is tuned down to the specific heat requirement by controlling the admitted quantity of excess air. The emitter tube is thus operated at lower temperatures from inlet to exhaust reducing or eliminating oxidation and maintaining maximum structural strength with lighter materials. Reduced overhead clearance requirements and facilitated installation also result.

Many other features and advantages of the invention including the configuration of the combustion chamber and interior liner thereof and the design of the excess air control means will become apparent upon reading of the following specification which is to be taken with the accompanying drawings.

BRIEF DESCRIPTION OF THE DRAWINGS

FIG. 4 is an exploded view of the excess air control portion of the burner unit;

FIG. 5 is a sectional view through a burner unit showing the excess air control in a fully opened condition;

FIG. 6 is a sectional view similar to that of FIG. 5 showing the excess air control in a substantially closed condition;

FIG. 7 is a cross-sectional view of the excess air control system of FIG. 5; and FIG. 8 is a detailed drawing of a length of aluminized steel emitter tube.

DETAILED DESCRIPTION OF THE SPECIFIC EMBODIMENT

Figure 1:
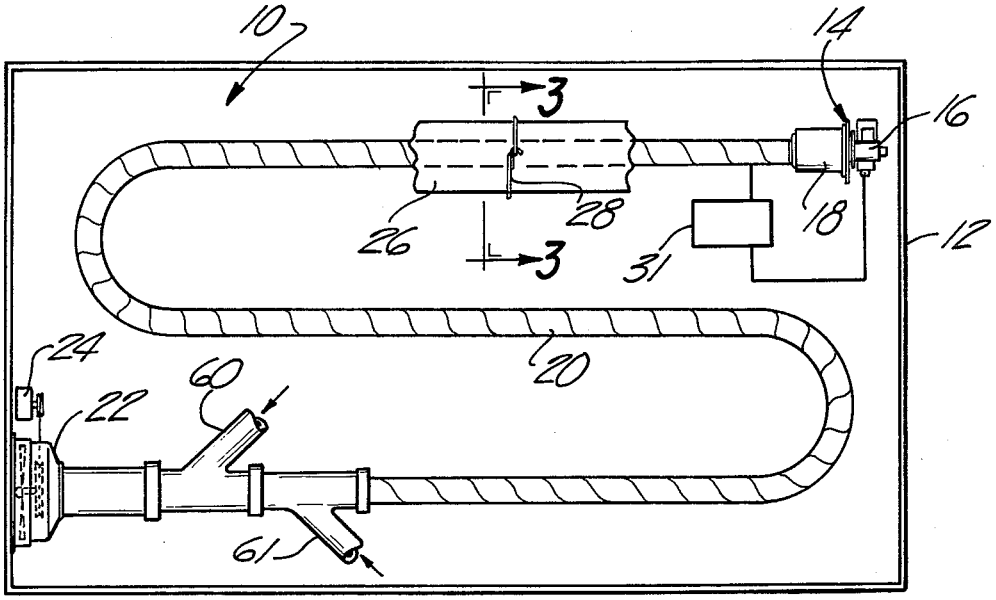
FIG. 1 is a plan view of a tube-fired radiant energy heating system of the type with which the invention may be employed.

FIG. 1 illustrates in plan view a radiant energy heating system 10 of the tube-fired type disposed overhead in a building 12 which defines the area to be heated. Heating system 10 comprises a burner unit 14 which may be oil-fired, gas-fired, or adapted for combinations thereof. The unit 14 is typically in the 70,000 to 400,000 BTU range. Burner unit 14 comprises a motor-driven pump assembly 16 for mixing fuel with primary combustion air and an igniter so as to produce a chemically correct or Stoichiometric fuel/air mixture for combustion within a cylindrical combustion chamber defined by housing 18. The combustion chamber within the housing 18 is connected to an aluminized steel emitter tube 20 which extends overhead throughout the building 12 to an exhaust fan 22 which communicates to the outside and is driven by a motor 24. The system 10 is provided with thermostatic or air-flow sensing controls so as to turn on the fan motor 24 and the burner 14 at the same time. A reflector 26 is disposed adjacent the heater tube 20 and held at the selected angle by means of a hanger 28 to direct the heat radiated from the tube. Although not specifically described herein, it will be understood that the burner control may comprise prepurge timers for gas/fuel applications and post-purge timers for oil applications. In all cases, the thermostatic control powers the exhaust and burner circuits and when the exhaust is up to speed an air flow switch 31 closes to start ignition.

Looking now to FIGS. 2, 4 and 5 through 7, the details of the burner unit 14 will be described.

Figure 2:
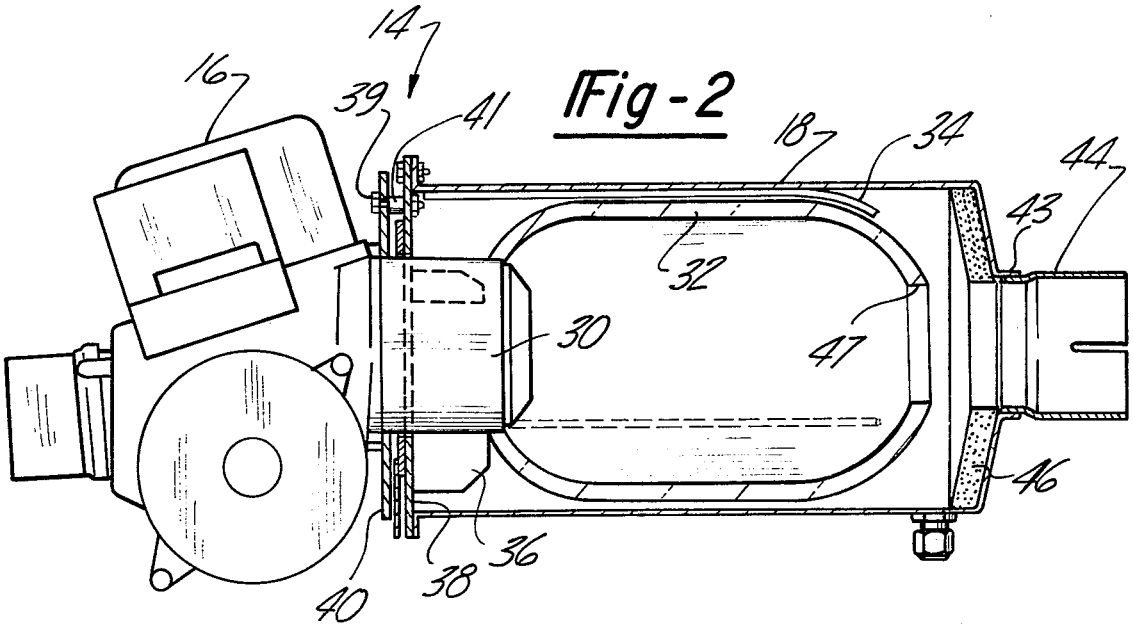
FIG. 2 is a cross-sectional view of a burner unit constructed in accordance with the invention.
Figure 3:
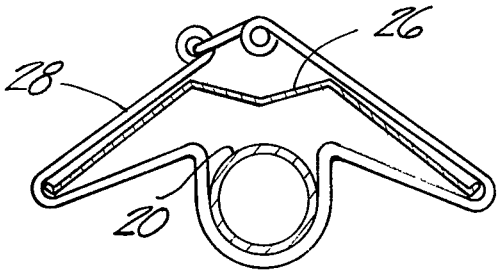
FIG. 3 is a sectional view through a length of a heater tube showing the orientation of the reflector apparatus in relation thereto.

Burner unit 14 comprises a cylindrical metal combustion chamber housing 18 having the fuel/air mixer and igniter assembly 16 mounted on the left end as shown in FIG. 2 with the nozzle and igniter unit 30 protruding coaxially into the housing 18 as shown. Assembly 16 may take the form of any of a variety of commercially available burner units adapted for oil or gas fuel. A satisfactory oil unit is available from the Wayne Home Equipment Co., Inc. of Fort Wayne, Ind. and is an underwriter approved direct spark ignition burner in the 70,000 to 4000,000 BTU range, Wayne Model EHAGO and EHGO.

Housing 18 contains a hollow liner 32 which is conically tapered at both ends and constructed of a flameproof material such as Pyrolyte. Liner 32 is open at both ends to provide a through flow of combustion products. The open left end of liner 32 as seen in FIG. 2 is disposed in close contact with the emitting end of nozzle unit 30 so as to receive the primary fuel/air mixture for combustion therein. Linear 32 is braced on the left side against a plurality of locater fins 36 which extend axially from an annular plate 38 which is bolted to the end flange of the combustion chamber housing 18 as best shown in FIGS. 2 and 4. End plate 38 is in turn secured by bolts 39 to the mounting plate 40 of the fuel/air mixer-igniter unit 16, spacers 41 being disposed between plates 38 and 40 to provide an inlet point for excess air as hereinafter described.

Combustion chamber liner 32 is held in radially spaced relation to the interior wall of the combustion chamber housing 18 by means of three or four rod-like spacers 34 which are welded or otherwise secured to the inside wall of the housing. The spacing between the liner 32 and the housing 18, together with plate 38, provides an excess air passage which permits ambient air to be drawn by the positive venting action of exhaust fan 22 through the apertures 42 in the end plate 38 and around the exterior of the liner 32 to the inlet end of the radiant energy heater tube 20. At this location, the cool ambient excess air flows into the heater tube 20 enveloping the hot products of combustion which are issuing from the opening 47 in the righthand of liner 32 along with the heated fuel/air mixture produced by the combustion process.

More specifically, it will be noted that the right-hand end of the housing 18 as seen in FIG. 2 is partially closed to form an axial aperture defined by flange 43 which in turn is welded to a tube fitting 44 adapted to receive the end of the heater tube 20 as shown in FIG. 1. A ring of heat-resistant insulator material 46 is disposed around the end of the housing 18 as shown. In this configuration the vessel-shaped configuration of the liner 32 permits the excess air drawn through the passage between the liner and the housing 18 to flow smoothly into the heater tube 20 through fitting 44 with minimum turbulence thus to protect the fitting 44 and the light-gage heater tube 20 from the high temperature gas mixture which is produced in the combustion chamber itself. The excess air is thus not involved in the combustion process but is substantially non-turbulently caused to flow into the heater tube by the positive exhaust vent 22 as previously described. In practice, it has been found that drawing maximum excess air around the combustion chamber line and smoothly into the inlet end of the emitter tube can reduce inlet temperatures from 3200° F. to approximately 2000° F. and produce a downstream $CO_2$ rating of approximately 4% as opposed to the 13% rating which is typical of a Stoichiometric fuel/air mixture in a conventional burner.

Looking now to FIGS. 4, 5 and 6 specifically, the details of the means for controlling the quantity of excess air which is admitted to the heating system will be described.

In FIG. 5 the annular end plate 38 carrying locater vanes 30 and excess air input apertures 42 is shown to fit coaxially with and in direct abutment to the end flange on the combustion chamber housing 18. The mounting plate 40 of the burner unit 16 is also disposed coaxial with the plate 38 and the cylindrical housing 18, a spaced relationship between plates 38 and 40 being maintained by spacers 41, as previously described. Tabs 48 are struck from flat steel stock and are welded to the plate 38 as shown in FIGS. 5 and 6 to receive and hold in circumferential sliding relationship a damper 50 having a handle 52 so as to be manually adjustable to block or unblock the apertures 52 in plate 38. A snug fit is desired so that the damper 50 is not subject to rattle or self-adjustment while at the same time permitting manual displacement by way of handle 52. FIG. 5 shows the damper 50 in a position to fully unblock the apertures 42 thus to admit maximum excess air. FIG. 6 shows the damper 50 in a position to substantially block the apertures 42 thus to admit minimum excess air to the passage which flows around the liner 32 and between the liner and the interior wall of housing 18 as previously described. Damper 50, like plate 38, is annular in configuration to permit the nozzle cylinder 30 to extend therethrough and into the vessel-shaped combustion chamber liner 32 in the manner shown in FIG. 2. FIG. 7 shows the details of the configuration of the tabs 48, the damper plate 50, and the end plate 38. Although primary and excess air are both drawn from the area to be heated in the illustrated system, it is to be understood that means may be provided to draw air from outside building 12.

As previously mentioned, an advantage of the subject invention is the relaxation of heat-resistant requirements in the tube 20 thus to permit a switch from stainless steel and/or heavy-gage steel tubing, which is extremely expensive, to either light-gage steel tubing or, preferably, spirally wrapped light-gage aluminized steel tubing of the type shown in FIG. 8. The tubing is fabricated by off-setting an edge of flat aluminized steel stock and wrapping the stock upon itself in a spiral configuration using a commercially available tube forming machine. Tubing 20 may be thereafter painted with a high emissivity rated paint to maximize radiant energy emissivity for given applications. The smooth conical taper of the Pyrolyte liner 32 as it approaches the inlet end of the tubing 20 contributes to the smooth flow of ambient excess air into the radiant heater tubing thus to limit the temperature of the tubing, preventing rapid oxidation caused by hot spots in the vicinity of the adapter fitting 44 and the first few feet of tubing 20 and maintaining structural strength.

In summary, it is apparent that the invention contemplates the use of large burner units having rated capabilities which would normally create excessive temperatures which could not be maintained in systems constructed from economical materials, and the "tuning down" of the system by the regulated admission of excess air to the inlet end of the radiant energy heater tube. In the preferred embodiment this is accomplished by means of a manually adjusted damper assembly which admits ambient excess air at the end of the combustion chamber housing in such a fashion as to cause that air to flow over and around the combustion chamber liner and smoothly into the tubing by way of the inlet end enveloping the combustion gases issuing from the combustion chamber outlets. The continuous flow of the excess air is caused by the power exhaust which is operative at all such times as the burner unit 14 is operative.

The power exhaust is very important to the operation of the invention and distinguishes the system described herein from pressure pulse responsive systems of the type represented by the aforementioned Cox patent. Exhaust fan capacity may be selected to provide approximately 0.75 cfm of air flow per 1000 BTU of fuel consumption per hour and assuming an outlet temperature of about 225° F. For example, a 150,000 BTU/hr. burner would require approximately 110 cfm.

Tube 20 is also selected as to size according to system heating specifications. Typically, 3.5 inch diameter tube may be used in systems up to 150,000 BTU/hr. and 5.0 inch diameter tube may be used for systems up to 3000,000 BTU/hr.

Several burners may be manifolded into one thermostatically controlled exhauster as suggested at 60, 61 in FIG. 1, each such burner having an air flow switch as described. Burner configuration may also vary; e.g., the fuel/air nozzle may be side mounted to admit the flame at 90° to the tube axis. Moreover, various fuels and/or fuel mixtures may be selected according to availability, price, and other factors.

The embodiments of the invention in which an exclusive property or privilege is claimed are defined as follows:

1. A radiant energy heating system comprising: a burner for producing heat through the combustion of a fuel/air mixture, said burner comprising a housing defining a large combustion chamber and a fuel nozzle adjacent one end thereof; an elongated radiant energy heater tube of a diameter substantially smaller than the diameter of the combustion chamber having an input end and an exhaust end and extruding through the area to be heated; the input end being connected to the other end of the combustion chamber housing for receiving the products of combustion; power exhaust means at said exhaust end for continuously drawing air through the tube from the burner during operation of the burner and discharging said products and air beyond the area to be heated thereby to produce a negative pressure within the heater tube; and excess air inlet means for admitting excess ambient air to said input end at a point downstream of the fuel/air combustion area under the forced draft of said power exhaust means to cool the heated primary air at said inlet end below the rated capability of said burner to limit tube temperatures so as to maintain strength of materials of construction and minimize oxidation.

2. A radiant energy heating system as defined in claim 1 wherein the burner comprises a flame resistant, low thermal conductivity liner within said housing and spaced from the interior walls thereof to define a passage; said liner opening at a first point to receive a fuel/air mixture for combustion therein, said liner opening at another point into said tube, said excess air inlet means being disposed on said housing to admit excess air to said passage whereby excess air flows around the liner and into the tube at the inlet.

3. A radiant energy heating system as defined in claim 2 including control means on said housing for adjusting the quantity of excess air which is admitted to said passage.

4. A radiant energy heating system as defined in claim 3 wherein said housing is cylindrical in configuration and comprises an opening in one end for admitting a fuel nozzle and igniter means and end plate disposed around said fuel nozzle and igniter means for closing the cylindrical housing and having a plurality of circumferentially distributed apertures formed therein, and circumferentially adjustable damper means displaceably carried on said end plate for varying the exposed areas of said apertures thereby controlling the quantity of secondary air passed therethrough.

5. Apparatus as defined in claim 2 wherein said housing is cylindrical in configuration, said liner is generally cylindrical in configuration and is disposed fully within said housing, the end of said liner adjacent the input end of said tube conically tapering in configuration such that excess air in said passage may flow smoothly over and around the exterior of the liner and into the input end of said tube to minimize impingement of hot gases on the tube to reduce tube oxidation and to pressure material strength.

6. Apparatus as defined in claim 1 wherein said heater tube is fabricated of a light-gage metal.

7. Apparatus as defined in claim 6 wherein the tube is of spirally wrapped fabrication.

8. Apparatus as defined in claim 1 further comprising radiant energy reflector means disposed adjacent said tube for directing radiant energy therefrom.

9. Apparatus as defined in claim 1 further including electrical switch means responsive to the flow of air through said heater tube to control operation of said burner.

10. A radiant energy heating system of the tube-fired type and comprising: a burner unit comprising a combustion chamber for producing a substantially fully burned fuel/air mixture, a light-gage metal heater tube connected to the burner for receiving the products of combustion and extending through the area to be heated to a discharge point, power means at said discharge point for continuously positively drawing air through the tube from the burner end to the discharge end, and excess air inlet means at said burner end for admitting excess air to the inlet end of the tube to cool the burned fuel/air mixture at the entry end of the tube.

11. Apparatus as defined in claim 10 including control means on said burner for controlling the quantity of excess air admitted to the inlet end of said tube.

12. Apparatus as defined in claim 10 including manifold means on said tube to receive products of combustion from other burners for discharge through a common point.

13. Apparatus as defined in claim 10 further including electrical switch means responsive to the flow of air through said heater tube to control operation of said burner.

* * * * *